US008622713B2

(12) United States Patent
Hampton

(10) Patent No.: US 8,622,713 B2
(45) Date of Patent: Jan. 7, 2014

(54) METHOD AND APPARATUS FOR DETECTING THE FLUID CONDITION IN A PUMP

(75) Inventor: Steven W. Hampton, Mustang, OK (US)

(73) Assignee: Little Giant Pump Company, Oklahoma City, OK (US)

( * ) Notice: Subject to any disclaimer, the term of this patent is extended or adjusted under 35 U.S.C. 154(b) by 618 days.

(21) Appl. No.: 12/648,609

(22) Filed: Dec. 29, 2009

(65) Prior Publication Data

US 2010/0166570 A1 Jul. 1, 2010

Related U.S. Application Data

(60) Provisional application No. 61/141,235, filed on Dec. 29, 2008.

(51) Int. Cl.
*F04B 49/06* (2006.01)
*F04D 27/00* (2006.01)

(52) U.S. Cl.
USPC ..... 417/53; 417/63; 417/44.11; 417/212; 417/213

(58) Field of Classification Search
USPC ..... 417/36, 38, 44.2, 44.11, 53, 63, 212, 417/213
See application file for complete search history.

(56) References Cited

U.S. PATENT DOCUMENTS

| | | | | |
|---|---|---|---|---|
| 5,076,763 | A | 12/1991 | Anastos et al. | |
| 5,324,170 | A | 6/1994 | Anastos et al. | |
| 5,549,456 | A | 8/1996 | Burrill et al. | |
| 5,701,065 | A * | 12/1997 | Ishizaki | 318/701 |
| 6,390,780 | B1 | 5/2002 | Batchelder et al. | |
| 6,534,947 | B2 | 3/2003 | Johnson et al. | |
| 6,715,996 | B2 * | 4/2004 | Moeller | 417/44.11 |
| 6,933,693 | B2 | 8/2005 | Schuchmann | |
| 7,309,216 | B1 | 12/2007 | Spadola, Jr. et al. | |
| 7,453,224 | B2 | 11/2008 | Sullivan | |
| 8,141,646 | B2 | 3/2012 | Allen et al. | |
| 8,224,492 | B2 | 7/2012 | Lakomiak et al. | |
| 2002/0015068 | A1 * | 2/2002 | Tsukada et al. | 347/19 |
| 2002/0018721 | A1 * | 2/2002 | Kobayashi et al. | 417/44.1 |
| 2003/0049134 | A1 * | 3/2003 | Leighton et al. | 417/40 |
| 2004/0117132 | A1 * | 6/2004 | Stephenson et al. | 702/35 |
| 2007/0154321 | A1 * | 7/2007 | Stiles et al. | 417/44.1 |

* cited by examiner

*Primary Examiner* — Peter J Bertheaud
*Assistant Examiner* — Dominick L Plakkoottam
(74) *Attorney, Agent, or Firm* — Faegre Baker Daniels LLP

(57) ABSTRACT

A pump control system which detects a fluid condition in a pump is disclosed. The pump control system may include a control event based on the fluid condition in the pump. The pump control system may detect a fluid condition in the pump by monitoring the frequency response of the pump.

12 Claims, 12 Drawing Sheets

METHOD AND APPARATUS FOR DETECTING THE FLUID CONDITION IN A PUMP

RELATED APPLICATIONS

This application claims the benefit of U.S. Provisional Patent Application No. 61/141,235, the disclosure of which is expressly incorporated by reference herein.

FIELD

The present invention relates to a method and apparatus for controlling a pump, and more particularly to a method and apparatus for controlling a pump by monitoring indications of the fluid condition within the pump.

BACKGROUND

In material transfer systems such as fluid transfer systems, it is often desired to assess the level of material in a vessel in order to determine when to initiate a control event. These control events could include turning on or off a pump, opening valves or drains, or adding material to the vessel. In the field of fluid transfer, as the fluid level in a reservoir becomes too high, the fluid is often transferred from the reservoir and discharged at another location such as another reservoir or into the environment. In sump pump applications, a basin is used to collect wastewater. When the level of wastewater rises to a pre-determined high point, the pump is switched on to drain the basin.

A number of devices, including ultrasonic sensors, capacitive sensors, thermal sensors, and float switches, are used to determine the water level in the vessel and to initiate a control event based on the water level. A float switch has moving parts which are prone to hanging up on solids in the wastewater or on other parts in the pump system, often causing the pump to malfunction.

One method to eliminate issues with moving parts in a pump system is to sense the overall electrical current that a pump uses to determine when the pump begins to take on air instead of wastewater, which would indicate a low water level in the basin. In a typical sump pump application, the pump draws a normal running current while pumping wastewater. When a large amount of air gets into the pump, the running current drops to a lower level. However, the same current drop can occur in any situation where the pump is pumping against a total head pressure and that pressure goes up. For example, a current drop may occur when a solid is caught in the discharge line or when the discharge line is being moved to a point of higher elevation. Because a number of events can affect the current drawn by the pump, relying on a current drop to detect a low fluid level in the basin may lead to a misdiagnosis of the fluid level and, consequently, an unreliable pump system.

SUMMARY

In an exemplary embodiment of the present disclosure, an electrically powered fluid transfer system is provided. The system comprises a pump having a fluid inlet and a fluid outlet in fluid communication with the fluid inlet. The pump moves fluid from the fluid inlet through an interior of the pump and onto the fluid outlet when power is provided to a motor of the pump. The system further comprises a controller operatively coupled to the pump to control when power is provided to the pump, the controller monitoring at least one characteristic of a frequency response of the pump while the pump is powered to determine a fluid condition within the pump.

In another exemplary embodiment of the present disclosure, a method of controlling an electrically powered fluid transfer system is provided. The method comprises the steps of providing a pump configured to displace a fluid, monitoring at least one characteristic of a frequency response of the pump while the pump is powered, determining a fluid condition within the pump based on the at least one characteristic of the frequency response of the pump, and altering an operation of the pump when the fluid condition within the pump is a first fluid condition.

BRIEF DESCRIPTION OF THE DRAWINGS

The above-mentioned and other features of the invention, and the manner of attaining them, will become more apparent and will be better understood by reference to the following description of embodiments of the disclosure taken in conjunction with the accompanying drawings, wherein.

Corresponding reference characters indicate corresponding parts throughout the several views. The exemplification set out herein illustrates embodiments of the invention, and such exemplifications are not to be construed as limiting the scope of the invention in any manner.

DETAILED DESCRIPTION OF THE DRAWINGS

Figure 1:
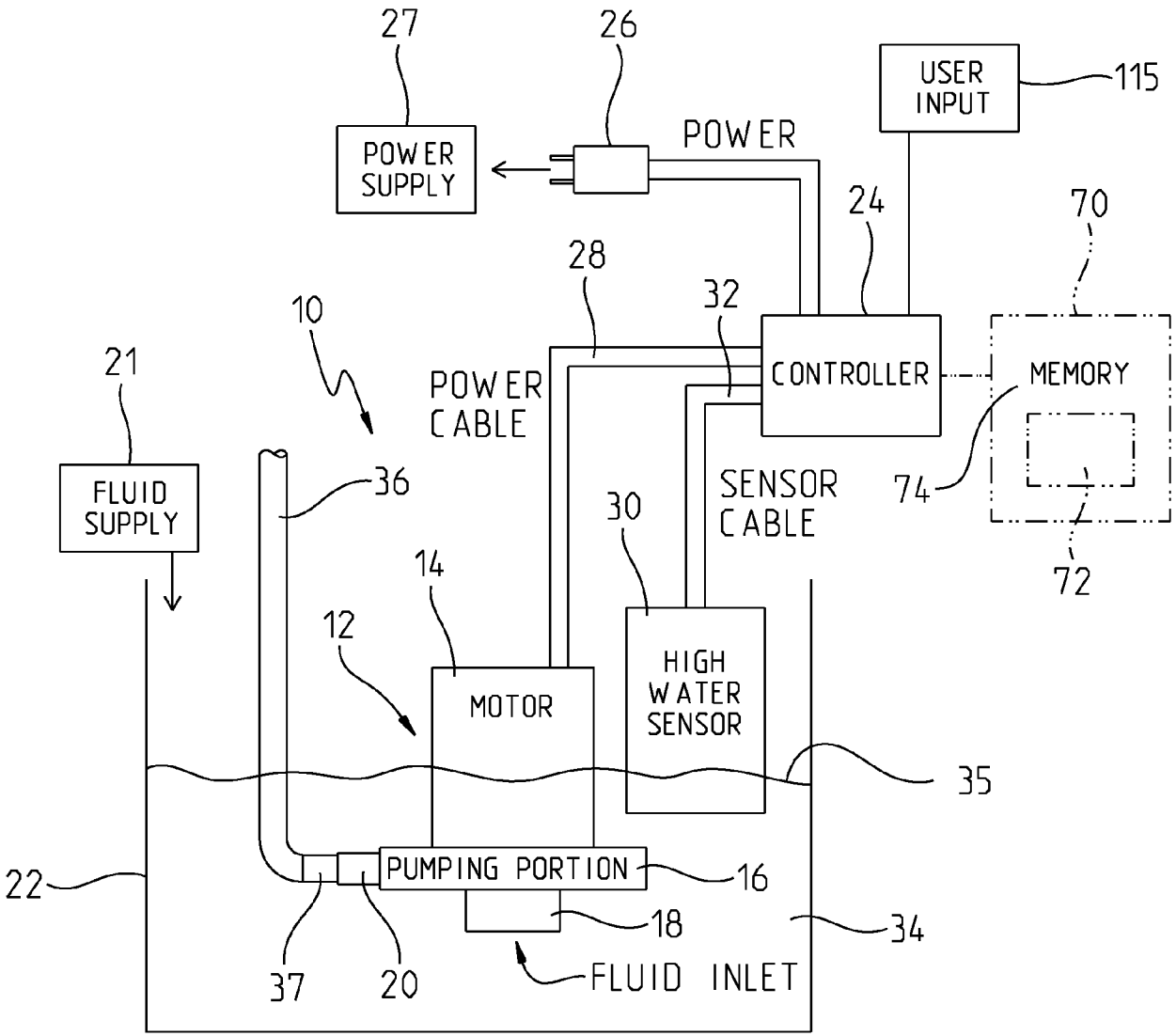
FIG. 1 illustrates a representative view of an exemplary pump system according to one embodiment.

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

The pump system of the present disclosure may be implemented in a variety of flowable material transfer applications, such as for transferring wastewater, sewage, effluent, surface water, fluids with suspended solids, or other suitable flowable materials in residential, commercial, agricultural, or industrial settings. In one embodiment, the pump system is used in residential applications for collecting and diverting surface drainage away from structures, erosion-prone landscapes, and poor drainage areas. In another embodiment, the pump system is used as a sump pump for collecting and removing water from a basement or crawl space pit. In another embodiment, the pump system is used as a bilge pump for removing water from a vessel.

Referring to FIG. 1, an exemplary pump system 10 is shown. Pump system 10 includes a pump 12 positioned in a reservoir 22 for pumping a flowable material out of reservoir 22. As described throughout this disclosure, pump 12 is configured to pump a fluid 34, illustratively a liquid such as water, from reservoir 22 to an outlet conduit 36. Other exemplary fluids may include gases, liquids, gels, liquids with suspended solids, and any other flowable materials displaceable by a pump. Reservoir 22 may be an aboveground or underground tank, a basin, a well casing, or any other suitable fluid containment device or fluid collection device. In the illustrated embodiment described herein, pump system 10 is a sump pump for pumping water collected in a reservoir positioned in the ground.

Fluid 34 is discharged into reservoir 22 from a fluid supply 21. Fluid supply 21 may be any fluid source that provides fluid to reservoir 22. Exemplary fluid supplies 21 include groundwater, condensate from an air conditioning system, condensate from a gas furnace, rainwater runoff, a municipal water supply, and any other system which provides fluid.

Pump 12 illustratively includes a motor 14 for driving pump 12. Motor 14 may be an alternating current (AC) or a direct current (DC) motor. In the illustrated embodiment described herein, pump 12 is a conventional centrifugal pump and motor 14 is a conventional AC induction motor, although any suitable pump and motor may be used. Motor 14 is coupled to a pumping portion 16 which includes an inlet 18 in fluid communication with an outlet 20. Pump 12 moves fluid received at inlet 18 through an interior of pumping portion 16 and out through outlet 20. In one embodiment, pumping portion 16 comprises a volute and an impeller in a centrifugal pump. Outlet conduit 36 is illustratively coupled to outlet 20 of pumping portion 16 to divert and discharge fluid 34 to a desired location outside of reservoir 22, such as to another reservoir or into the environment. A conventional one-way check valve 37 may be provided in outlet conduit 36 to prevent backflow of fluid 34.

In the illustrated embodiment, pump system 10 further includes a sensor module 30 positioned in reservoir 22 for detecting a top level 35 of fluid 34 and providing feedback to a controller 24. In one embodiment, sensor module 30 sends feedback to controller 24 to indicate detection of a high fluid level in reservoir 22. In response, controller 24 sends a control signal to activate pump 12 to thereby displace fluid 34 from reservoir 22 and lower top level 35 of fluid 34 in reservoir 22. In one embodiment, sensor module 30 may be used to detect a low fluid level in reservoir 22. In one embodiment, sensor module 30 may be positioned outside of reservoir 22 while still being able to detect top level 35 of fluid 34 in reservoir 22. For example, sensor module 30 may be placed near the outer wall of reservoir 22 and detect top level 35 through the outer wall of reservoir 22. Sensor module 30 is illustratively a capacitive sensor, although an ultrasonic sensor, a thermal sensor, a float switch, or any other suitable sensor may be used. Exemplary sensor modules are disclosed in further detail in U.S. patent application Ser. No. 12/645,137, filed Dec. 22, 2009, entitled "METHOD AND APPARATUS FOR CAPACITIVE SENSING THE TOP LEVEL OF A MATERIAL IN A VESSEL", which is incorporated by reference herein. Although only one sensor is shown in FIG. 1, any number of sensors may be used to detect top level 35 of fluid 34, thus providing the potential to detect the top level at various heights within reservoir 22 and/or providing redundant sensors to detect the top level at the same height within reservoir 22.

Controller 24 is configured to monitor and control pump 12. Controller 24 illustratively receives power via a power cable 26 from a power source 27. In one embodiment, power source 27 is an AC power supply, but may alternatively be a DC power supply. Controller 24 is operatively coupled to pump 12 via a motor cable 28 for providing controls and power to motor 14. Controller 24 is operatively coupled to sensor module 30 via sensor cable 32 for receiving feedback from sensor module 30. Alternatively, controller 24 may be operatively coupled to pump 12 and sensor module 30 using wireless communication. In the illustrated embodiment, controller 24 is positioned outside of reservoir 22 but may alternatively be positioned inside reservoir 22.

Figure 2A:
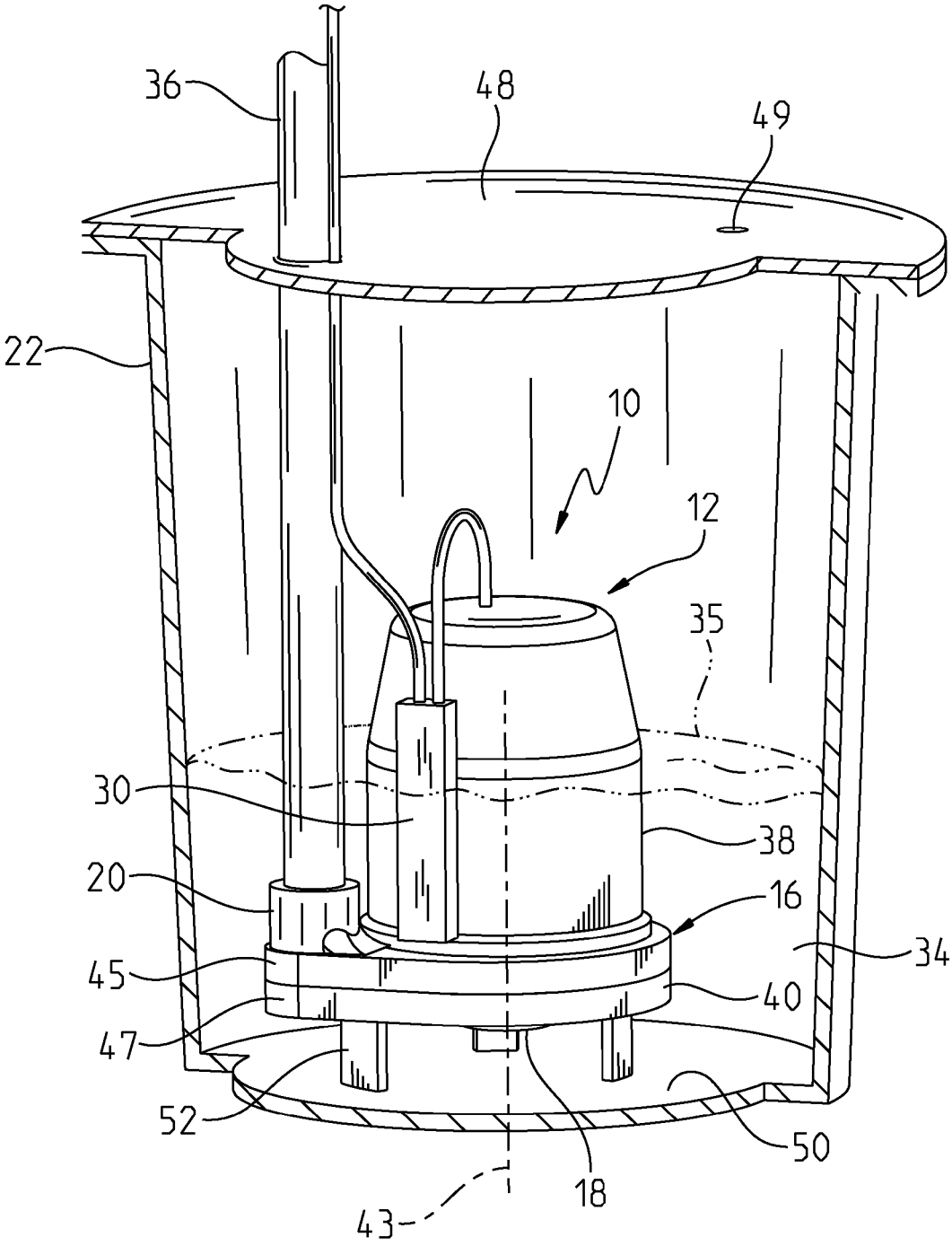
FIG. 2A illustrates an exemplary pump system having a high fluid level.
Figure 2B:
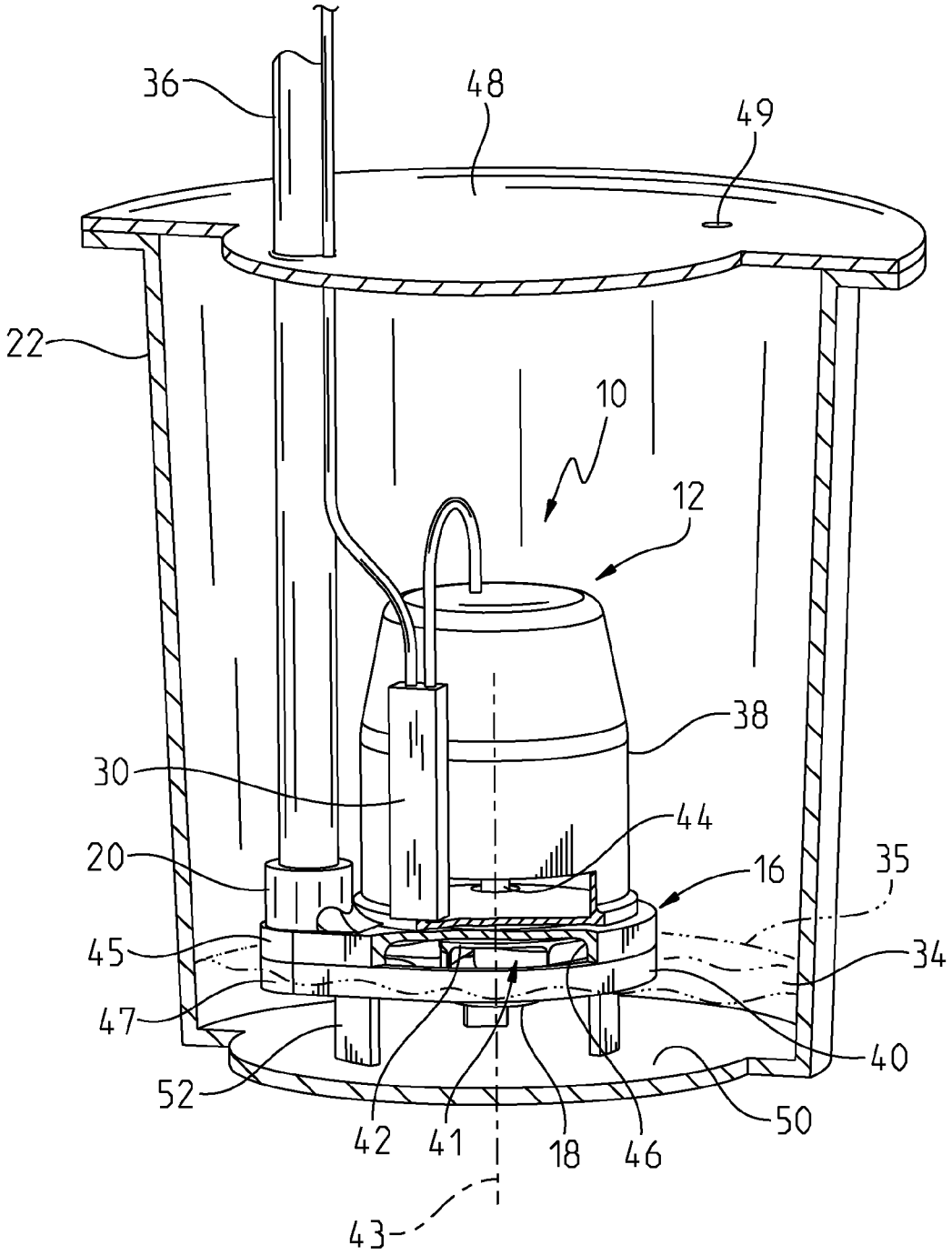
FIG. 2B illustrates the pump system of FIG. 2A having a low fluid level.

Referring to FIGS. 2A and 2B, in one embodiment, pump 12 includes legs 52 which are mounted to a floor 50 of reservoir 22 to secure pump 12 within reservoir 22. Reservoir 22 further includes a removably attached lid 48 which provides access to pump 12. Motor 14 is enclosed in a protective rigid housing 38 which protects motor 14 from the surrounding environment, such as from fluid 34 in reservoir 22. Pumping portion 16 of pump 12 includes a volute 40 having an upper portion 45 and a lower portion 47. Volute 40 further includes an interior portion 41 (see FIG. 2B) for receiving fluid 34 through inlet 18. As illustrated in FIG. 2B, an impeller 42 is positioned within interior portion 41 of volute 40 and near inlet 18. Motor 14 includes a shaft 44 coupled to impeller 42 for rotatably driving impeller 42 about an axis 43. In one embodiment, rigid housing 38, volute 40, and impeller 42 are each made of cast iron and have a protective epoxy coating to guard against corrosion.

In the illustrated embodiment, fluid 34 is water which is displaceable by pump 12. During operation, the rotation of impeller 42 draws the water into volute 40 through fluid inlet 18 near the rotating axis 43 of impeller 42. Using centrifugal acceleration, the rotation of impeller 42 accelerates the water radially outward to a wall 46 of volute 40. The velocity of the water decreases as the water is forced from volute 40 through the smaller cross-sectional area of fluid outlet 20, which results in an increase in water pressure inside volute 40 as the kinetic energy of the water in volute 40 is converted into potential energy. This increased water pressure forces the water through fluid outlet 20 and into outlet conduit 36.

During operation of pump 12, motor 14 draws electrical power from power supply 27 and produces a torque on shaft 44 to rotate impeller 42 about axis 43. The electrical power supplied to the motor may be represented as:

$$P_e = V \times I \times \mathrm{PF} \tag{1}$$

wherein $P_e$=electrical power, V=voltage applied across the winding of the motor, I=current drawn through the winding of the motor, and PF=power factor. The rotational mechanical power of the motor, which is output by the motor through the rotation of the motor shaft, may be represented as:

$$P_m = T \times 2\mu \times S \tag{2}$$

wherein $P_m$=mechanical power, T=torque applied by motor, and S=angular speed of motor. Since a motor is not 100% efficient in converting electrical power into mechanical power, an efficiency factor must be used to relate the input of the motor (i.e. electrical power) to the output of the motor (i.e. mechanical power), as represented by the following equation:

$$P_m = P_e \times n_{eff} \quad (3)$$

wherein $n_{eff}$=the efficiency of the motor. Substituting the above equations for $P_m$ and $P_e$, the governing equation for the transfer of electrical to mechanical power in the motor is:

$$T \times 2\mu \times S = V \times I \times \mathrm{PF} \times n_{eff} \quad (4)$$

The torque from motor 14 is applied to impeller 42 via shaft 44. As shown by the above equation (4), the torque applied by motor 14 is proportional to the current and voltage levels of motor 14. Impeller 42 physically transfers the torque to the water during the rotation of impeller 42. The efficiency of this torque transfer depends on the condition of the fluid in pump 12. As different ratios of compressible and incompressible fluids, such as a mixture of water and air, are drawn into volute 40, the torque applied by motor 14 and the current drawn by motor 14 changes.

When the water level in reservoir 22 is at a high level, such as the top level 35 of fluid 34 shown in FIG. 2A, pump 12 operates in a "normal" state and water from reservoir 22 is drawn into volute 40 at full or substantially full flow. Since water is generally incompressible, the torque transfer from impeller 42 to the water entering volute 40 increases the water pressure inside volute 40 and forces the water in volute 40 through fluid outlet 20 to outlet conduit 36. In one embodiment, as water is pumped out of reservoir 22 by pump 12, air from the atmosphere enters reservoir 22 through an opening or vent 49 to replace the water displaced by pump 12. Vent 49 is illustratively located in lid 48, but may alternatively be in any suitable location to allow air to enter reservoir 22.

As pump 12 continues to pump water from reservoir 22 through outlet 20, the water level in reservoir 22 steadily decreases and eventually drops below inlet 18 of pump 12, as illustrated by the top level 35 in FIG. 2B. As pump 12 continues to operate, varying amounts of air from reservoir 22 are drawn into volute 40. As a result, pump 12 begins to operate in a "starved" state by drawing a mixture of air and water into volute 40. Air has a smaller mass density than water and is a compressible fluid. Accordingly, the torque transferred from impeller 42 to the air/water mixture in volute 40 works to both compress the air in volute 40 and change the velocity of the water entering volute 40. As a result, the torque transfer to the water is reduced, and the pressure in volute 40 decreases. In addition, the current drawn by motor 14 is reduced. In one embodiment, pump 12 operates in a starved state when air comprises anywhere from at least about 5% of the fluid in volute 40 to about 100% of the fluid in volute 40, but pump 12 may operate in a starved state when a lesser amount of air is in volute 40 depending on the mechanical and structural characteristics of pump 12.

In one embodiment, pump 12 may be initially powered on when the water in reservoir 22 is at a low level. The low water level may include reservoir 22 being substantially empty or at any level at or below inlet 18. With the water at a low level, pump 12 immediately operates in a starved state upon receiving power as air comprises about 100% of the fluid in volute 40.

By examining the current or voltage supplied to motor 14 of pump 12, motor 14 may be used as a feedback sensor to controller 24 for indicating a condition of the fluid surrounding impeller 42 within volute 40. However, monitoring the overall motor current level to detect the fluid condition in volute 40 may lead to false results as a plurality of different events can cause the same amount of current to be drawn by pump 12.

In one embodiment, the frequency response of the power supplied to motor 14 is monitored by controller 24. The frequency response measures the output frequency spectrum of pump 12 in response to a sinusoidal power signal supplied to motor 14. Controller 24 monitors characteristics of the frequency response of the voltage or current levels to detect a change in the operating condition of pump 12, as described herein. Exemplary characteristics of the frequency response include the magnitude at select frequencies and the phase angle at select frequencies.

A "signature" of the frequency response of pump 12 indicates certain frequencies, certain magnitudes, certain phase angles, the magnitude of the response over a range of frequencies, the phase angle of the response over a range of frequencies, and other characteristics of the frequency response of pump 12. By examining the differences in the signature during a normal operating state and a starved operating state of pump 12, controller 24 may identify a frequency range of interest where the magnitude or phase are most affected by a change in the condition of the fluid in pump 12. Controller 24 then monitors the current or voltage levels over the frequency range of interest to detect a change in the magnitude or phase of the power signal which indicates the fluid condition in the pump, as described below.

In one embodiment, controller 24 is an analog circuit configured to monitor the current signal of motor 14 and to compare a relative value of the current signal to a threshold value for detection of the fluid condition in pump 12. In one embodiment, the analog circuit monitors the current signal of motor 14 at a given frequency range, as explained herein. Alternatively, the analog circuit may be used to monitor any suitable electrical parameter of pump 12 which indicates the condition of the fluid being displaced by pump 12.

In one embodiment, controller 24 may include a microprocessor 70 (see FIG. 1) configured to perform some or all of the functions of the analog circuit. As illustrated in FIG. 1, microprocessor 70 includes fluid detection software 72 provided on a memory 74 accessible by microprocessor 70. In one embodiment, fluid detection software 72 includes instructions which cause microprocessor 70 to monitor and analyze characteristics of the frequency response of pump 12 to detect the fluid condition in pump 12. In one embodiment, fluid detection software 72 includes instructions which cause microprocessor 70 to apply a fast Fourier transform ("FFT") to the power signal of pump 12 to obtain the frequency response of pump 12, as explained herein.

In the illustrated embodiment, controller 24 first obtains the frequency response of pump 12 and analyzes a frequency range of interest based on deviations in the signature of the frequency response, as described herein. The frequency response of the voltage supplied to motor 14 or the current drawn by motor 14 is obtained by applying a FFT to the power signal. The FFT extracts both the magnitude and phase components of the frequency response of the power signal. The FFT is a mathematical approximation of any given group of data points using a series of sine and cosine functions with different amplitudes.

By applying the FFT to the current signal drawn by motor 14, the magnitude and phase angle of the pump's frequency response may be obtained for any given frequency. In one embodiment, microprocessor 70 applies the FFT to the current signal. Software 72 includes instructions which cause microprocessor 70 to run a digital algorithm to apply the FFT to the current signal and extract the frequency response of the current signal. Alternatively, any other suitable method for extracting the frequency response of the current signal may be used.

Figure 3:
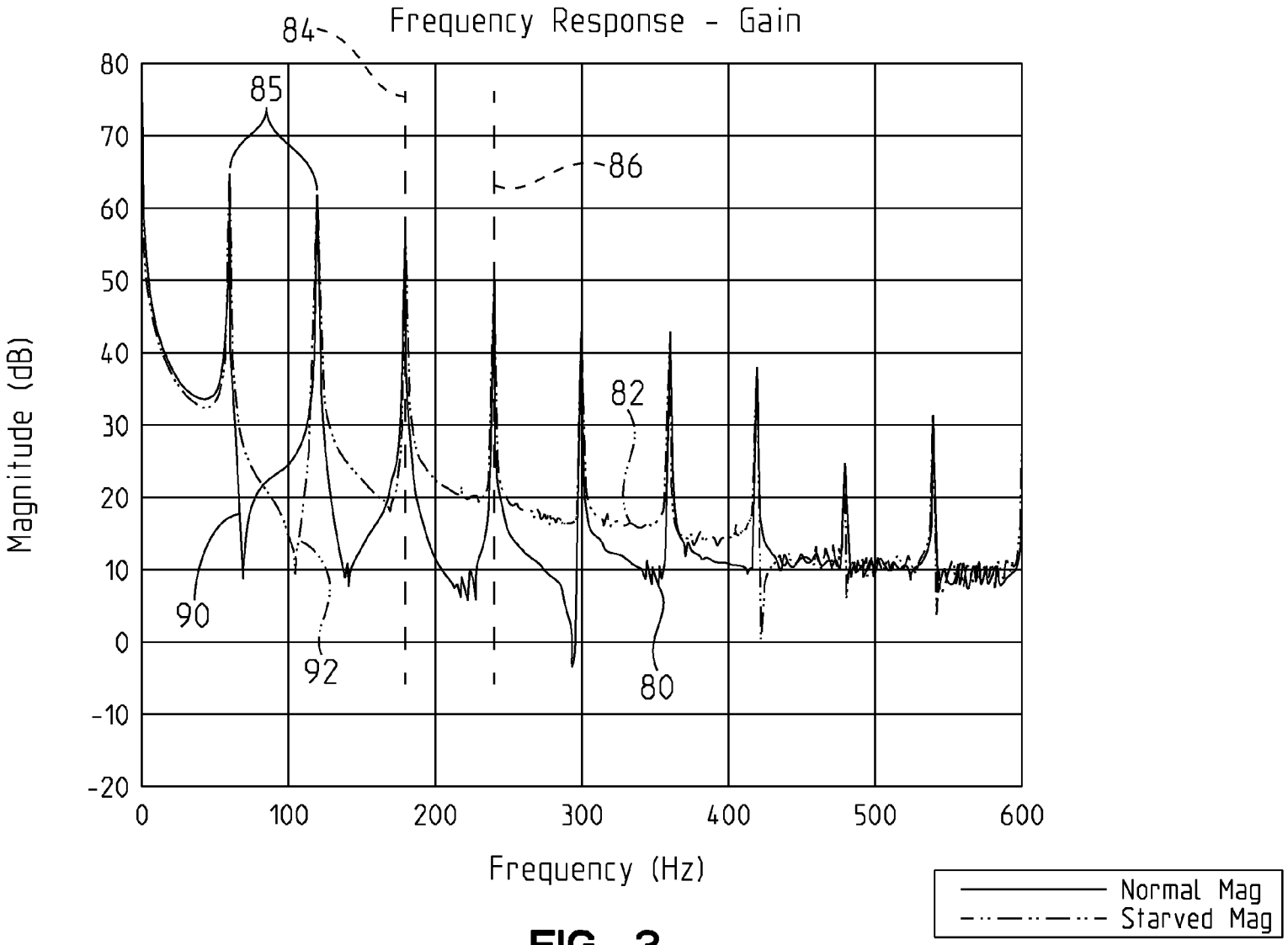
FIGS. 3 and 4 illustrate the magnitude and phase angle of an exemplary frequency response of the pump system of FIG. 2A for a variety of fluid states.
Figure 4:
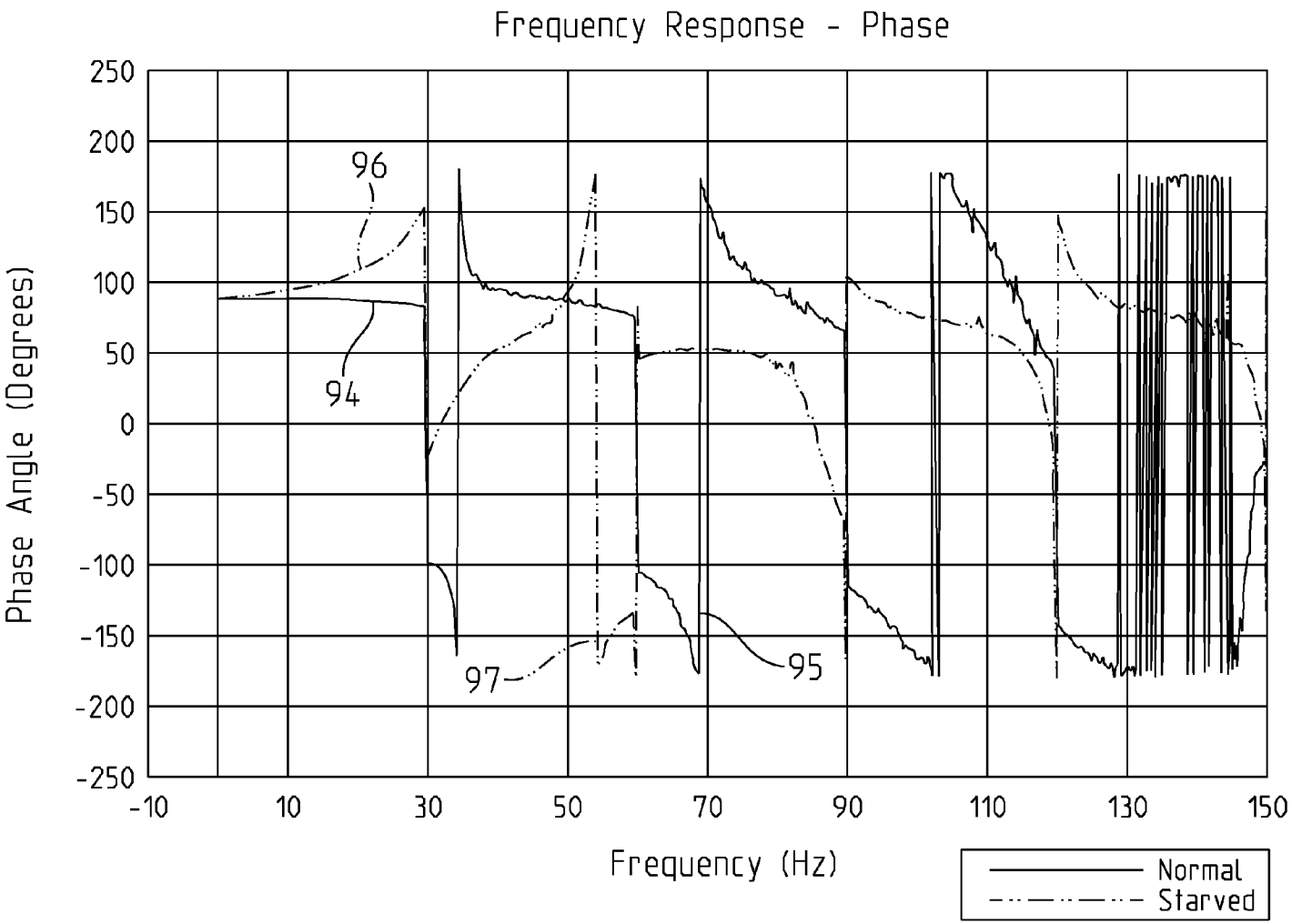

Referring to FIGS. 3 and 4, the magnitude and phase angle of an exemplary frequency response of the current drawn by motor 14 is shown. The magnitude is shown in decibels and the phase angle in degrees. The graphs in FIGS. 3 and 4 are illustrative of the frequency response of one exemplary pump system having a unique set of characteristics and conditions. Different pump systems will have different frequency responses.

As shown in FIG. 3, the frequency response of pump 12 varies depending on whether pump 12 is operating in a normal or a starved state. While in a normal operating state, pump 12 is operating at or near full water flow, as described above. The frequency response while pump 12 is in the normal state is indicated by a normal response 80. When pump 12 is operating in a starved state, a mixture of air and water is present in interior portion 41 of volute 40, as described above. The frequency response while pump 12 is in the starved state is represented by a starved response 82.

The deviation in the normal response 80 and starved response 82 provide indication of the fluid condition in pump 12. A frequency range of interest is selected where the magnitude of normal response 80 substantially deviates from the magnitude of starved response 82. In the illustrated embodiment shown in FIG. 3, a frequency range of interest is selected between a low cutoff 84 of 180 Hz and a high cutoff 86 of 240 Hz. Between low cutoff 84 and high cutoff 86, starved response 82 has a greater magnitude than normal response 80. Other suitable frequency ranges may be selected to capture the differences in the normal response 80 and starved response 82. Once one or more frequencies or frequency ranges of interest are identified, controller 24 may be configured to analyze these frequencies or frequency ranges to detect the fluid condition in pump 12.

Several factors contribute to the frequency response of the current signal or of any electrical parameter of pump 12. These factors include the harmonics and magnitude of the current signal, the natural or "structural" frequencies of the physical parts of the pump system, and the overall "white noise" from various noise sources that defines the noise floor of pump 12. The noise floor is defined by the sum of all of the noise sources in pump 12, including the noise resulting from the excitation of the parts of pump 12 at their natural frequencies and the random introduction of air pockets into volute 40 as pump 12 moves from a normal to a starved operating state. As illustrated in FIG. 3 and described herein, the noise floor of the starved response is higher at certain frequencies than the noise floor of the normal response.

The introduction of fluid into pump 12 results in the excitation of the parts of pump 12, such as volute 40 or impeller 42, at their natural frequencies, which changes the signature of the frequency response of the current signal drawn by motor 14. In particular, the excitation of the parts of pump 12 at their natural frequencies creates additional "noise" in pump 12 and increases the magnitude of the frequency response at those natural frequencies. The magnitude of vibration of the parts at their natural frequencies depends on the condition of the fluid present in pump 12. In particular, the presence of air in pump 12 causes the parts of pump 12 to resonate at their natural frequencies at a greater magnitude than the presence of water in pump 12. Accordingly, the operation of pump 12 in a starved state may result in a greater magnitude at any natural frequency peak in the response. This greater magnitude in the signature of the frequency response may be observed to detect the presence of air in pump 12. In addition, the excitation of the parts of pump 12 may also cause a phase shift in the phase response, as described below and illustrated in FIG. 4.

The natural frequencies of the parts of pump 12 depend on the physical properties of the parts such as their mass and structural stiffness. The natural frequency for an undamped free vibration of a single degree of freedom system may be represented as:

$$w_n=\sqrt{k/m} \tag{5}$$

wherein $w_n$=the natural frequency, k=the stiffness of the pump structure, and m=the mass of the pump structure. As such, the natural frequency of a structural part of pump 12 is proportional to the stiffness of the structural part and inversely proportional to the mass of the structural part. A part with a solid or rigid structure will have a higher natural frequency than a part with a more flexible structure.

In addition, changes in the level of damping in pump'12 result in a change in the noise floor of the frequency response. In general, a damped system has a greater resistance or impedance to vibration than an undamped system. As such, the frequency response of a damped system typically has a lower noise floor than the frequency response of an undamped system due to the smaller magnitude of noise sources detected in the frequency response. For pump system 10, the level of damping in pump 12 is dependent on the amount of compressible gas, such as air, in pump 12 and the effective mass of the fluid in pump 12. The introduction of air in pump 12 results in a decrease in the damping level of pump 12 and a lower mass density of the fluid mixture in pump 12. As a result, the noise floor of the frequency response increases.

In particular, as pump 12 changes operating states from pumping a liquid, such as water, to pumping a mixture of liquid and compressible gas, such as water and air, the "stiffness" and mass of the fluid mixture surrounding impeller 42 continuously changes due to the compressibility of the air, the varying damping level in pump 12, and the varying mass transfer through pump 12. As a result, the force transferred to the air/water mixture and the resultant torque in pump shaft 44 changes as varying amounts of air enter pump 12. The randomness of the size, the quantity, and the timing of entry of air pockets in pump 12 results in random changes to the compressibility of the fluid surrounding impeller 42 and to the damping of oscillations in pump 12. As a result, the noise floor of the frequency response increases over a certain frequency range as these air pockets enter pump 12, as illustrated by normal response 80 and starved response 82 in FIG. 3. The noise floor increases particularly at lower frequencies as most noise due to the introduction of air in pump 12, including the vibration of the structural parts of pump 12, occurs at these lower frequencies. Thus, the difference in magnitude of the frequency response between low cutoff 84 and high cutoff 86 (see FIG. 3) provides an indication that air is in pump 12.

A change in the damping level in pump 12 may also cause a frequency shift in some peaks in the frequency response, such as a shift in a lower or "anti-resonance" peak of the response. An anti-resonance peak illustrates the frequency or frequencies at which the system has a large resistance or impedance to vibration. As illustrated in FIG. 3, an anti-resonance peak 90 of normal response 80 at about 70 Hz shifts to an anti-resonance peak 92 of starved response 82 at about 105 Hz due to the introduction of air into pump 12. In one embodiment, the frequency shift in the anti-resonance peak of the frequency response may be observed to detect the fluid condition in pump 12. Using microprocessor 70, the location of the anti-resonance peak may be identified to detect a frequency shift and distinguish a normal operating state from a starved operating state.

In one embodiment, motor 14 is an AC motor operating at 60 Hz, but AC motor may operate at 50 Hz or any other suitable frequency. The frequencies of the harmonics of the current signal drawn by motor 14 are therefore 60 Hz, 120 Hz, 180 Hz, 240 Hz, etc. As such, the contribution of the current signal to the magnitude of the frequency response is greatest at each 60 Hz interval, as shown in FIG. 3 by peaks 85 at each 60 Hz interval. In one embodiment, the 60 Hz harmonics may be filtered out of the signal either through digital processing with microprocessor 70 or by an analog circuit. Filtering out the 60 Hz harmonics of the current signal increases the sensitivity of controller 24 in the detection of the specific structural frequencies in pump 12 and the noise floor of intermediate frequencies in pump 12.

Referring to FIG. 4, the phase angle response of the current signal is shown when pump 12 is operating in both a normal state and a starved state. The phase response while pump 12 is in the normal state is indicated by normal response 94, and the phase response while pump 12 is in the starved state is indicated by starved response 96. By selecting a specific frequency range where the phase angle of normal response 94 differs from the phase angle of starved response 96, the phase angle may be monitored over that frequency range to detect a starved operating state of pump 12. In one embodiment, microprocessor 70 monitors the phase angle over the frequency range to detect the operating state of pump 12. As illustrated in FIG. 4, normal response 94 has a lower peak 95 at about 68 Hz, while starved response 96 has a lower peak 97 at about 54 Hz. Microprocessor 70 may monitor the phase angle of the current signal over a range of about 50 to 70 Hz to detect this phase shift.

Upon observing the frequency response of the motor current signal, or of any other suitable electrical parameter of pump 12, and selecting a frequency range of interest based on the frequency response, controller 24 is configured to monitor the current signal within the frequency range of interest. In one embodiment, controller 24 monitors a relative value of the magnitude of the current within the selected frequency range of interest and compares the relative value to a threshold value to detect a change in the fluid condition in pump 12. In one embodiment, controller 24 initiates a control event upon detection of the change in fluid condition. An exemplary control event is the deactivation of pump 12. In another embodiment, controller 24 initiates an alarm event upon detection of the change in fluid condition in pump 12.

Figure 5:
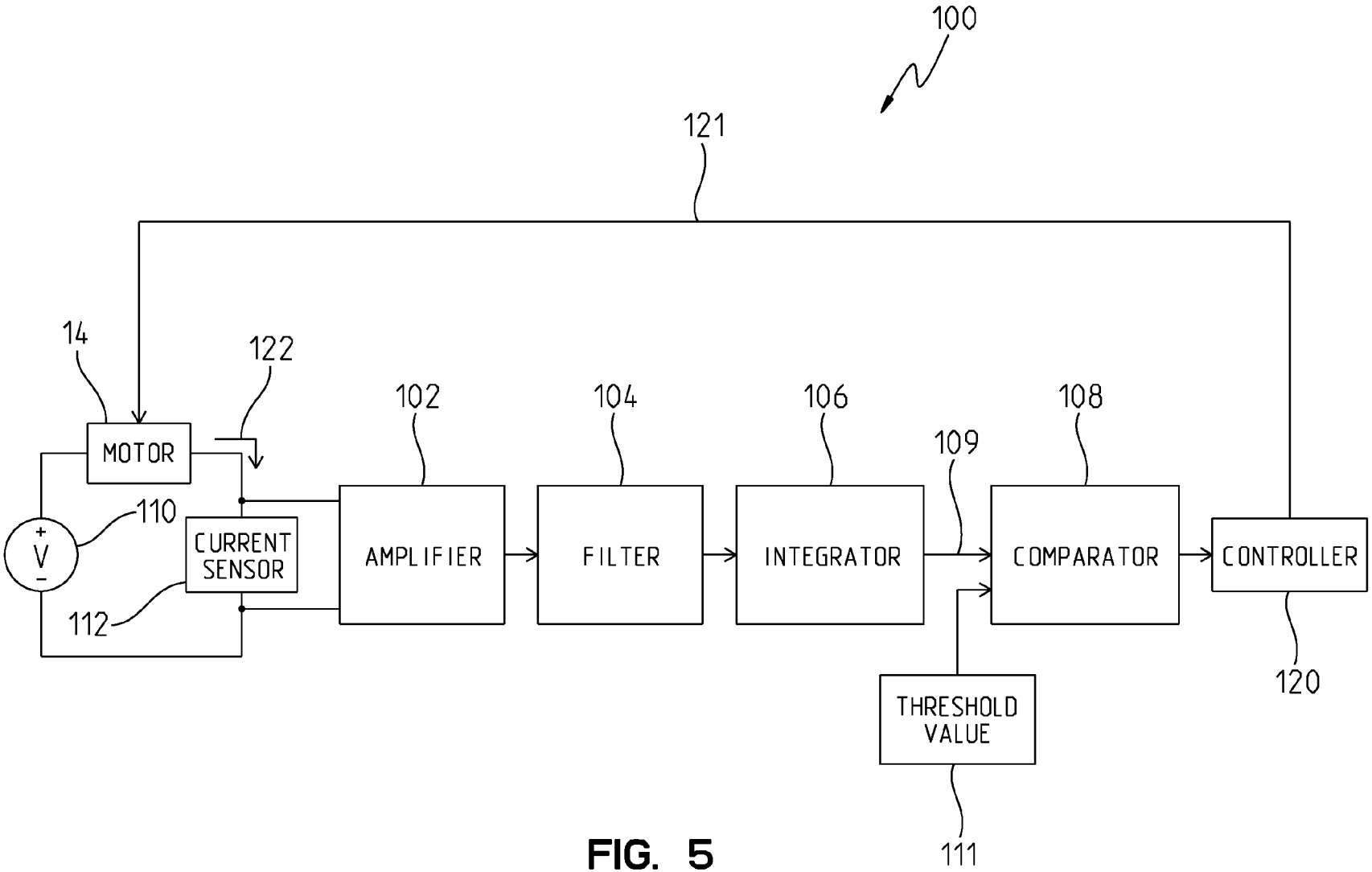
FIG. 5 illustrates a representative view of an exemplary controller of the pump system of FIG. 1.

Referring to FIG. 5, an analog circuit 100 is shown as an exemplary controller 24. During operation of pump 12, motor 14 draws current from a power source 110. In the illustrated embodiment, power source 110 is an AC power supply, and controller 24 delivers power from power source 110 to motor 14. In one embodiment, power source 110 corresponds to power source 27 of FIG. 1. A current sensor 112 is connected in series with motor 14. In one embodiment, current sensor 112 is a sense resistor, but other suitable current sensors may be used. Circuit 100 includes several circuit stages, including an amplifier 102 configured to amplify a signal, a filter 104 configured to filter a signal to a specific frequency range, an integrator 106 configured to average the magnitude of a signal over a period of time, a comparator 108 configured to compare the relative magnitude of a signal to a threshold value 111, and a controller 120 configured to communicate a control signal 121 to motor 14. In one embodiment, filter 104 and integrator 106 are tunable to account for the unique characteristics and properties of each pump system.

The relative value of the current signal is dependent on the magnitude of the current being drawn by pump 12. For example, an increase in the magnitude of the current signal at a frequency within the frequency range of interest will result in a corresponding increase in the observed relative value of the current signal, and vice versa. The threshold value is selected such that when pump 12 is operating in a normal condition, the relative value is less than the threshold value. When pump 12 is operating in a starved condition, the relative value exceeds the threshold value as a result of the increased magnitude of the current signal at frequencies within the frequency range of interest. Alternatively, the relative value of the current signal may, be monitored such that the relative value dropping below the threshold value would indicate that pump 12 is operating in a starved condition.

Figure 6:
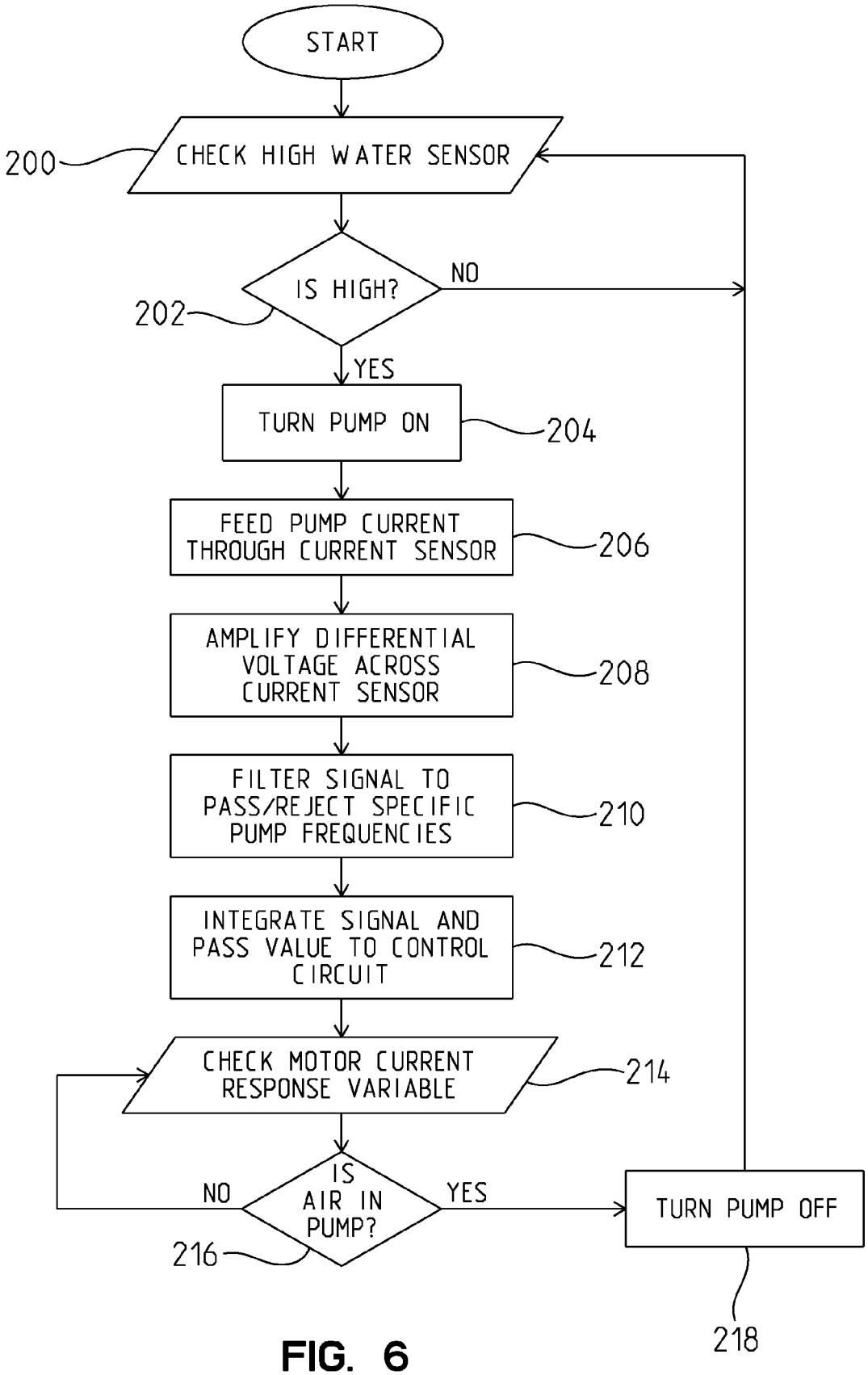
FIG. 6 illustrates a flowchart of the operation of the pump system of FIG. 1 and the controller of FIG. 5.

FIG. 6 illustrates the operation of pump system 10 according to one embodiment. Reference is made to analog circuit 100 of FIG. 5 throughout the following description of the flowchart of FIG. 6. As represented by blocks 200 and 202, top level 35 of fluid 34 (see FIG. 1), illustratively water, in reservoir 22 is continuously monitored by sensor module 30. Controller 120, based on sensor module 30, detects a high water level in reservoir 22. As represented by block 204, controller 120 turns on pump 12 upon the detection of a high water level in reservoir 22.

In block 206, the current drawn by motor 14, illustratively a current signal 122 in FIG. 5, is fed through current sensor 112 of circuit 100 which is monitored by amplifier 102 of circuit 100. In the illustrated embodiment, motor 14 is an AC motor and current signal 122 is a sinusoid. Amplifier 102 multiplies the voltage difference across current sensor 112 by the gain of amplifier 102, as represented by block 208. As a result, the output of amplifier 102 is a sinusoidal signal dependent on the amplitude of current signal 122 as detected by current sensor 112.

As represented by block 210, filter 104 filters out certain frequencies from pump system 10 that are present in the output of amplifier 102. In one embodiment, filter 104 is a band pass filter configured to pass a range of frequencies as defined by its bandwidth, although one or more low or high pass filters may also be used. The bandwidth of filter 104 is set to the frequency range of interest which, as described above, is based on the physical properties of the pump structure and is determined from the observation of the frequency response of the current signal for known states of the pump. In one embodiment, filter 104 is tuned to have a bandwidth defined between low cutoff 84 and high cutoff 86, as shown in FIG. 3, to capture the increased noise floor of the frequency response of pump 12 that results from the presence of air in pump 12.

As represented by block 212, integrator 106 integrates the filtered output of filter 104 and outputs a response variable 109 to a control circuit, illustratively comparator 108 in FIG. 5. In one embodiment, integrator 106 is a simple first order integrator. Response variable 109 is an average of the magnitude of the sinusoidal output of filter 104 over a specific pre-determined time period. In one embodiment, response variable 109 is an average of the sinusoidal voltage output of filter 104. Response variable 109 represents a relative value of the current signal drawn by motor 14 and is dependent on the magnitude of the current signal and the frequencies present in pump system 10. For example, with the bandwidth of filter 104 set between low cutoff 84 and high cutoff 86 (see FIG. 3), filter 104 captures at least some of the frequencies at which the introduction of air into volute 40 affects the magnitude of the frequency response. As the amount of air in the air/water mixture in pump 12 increases, the magnitude of response variable 109 correspondingly increases.

In the illustrated embodiment, the time period over which integrator 106 calculates response variable 109 is set by tuning at least one parameter of integrator 106. Integrator 106 may be tuned in accordance with the characteristics and physical properties of each individual pump system.

Figure 7:
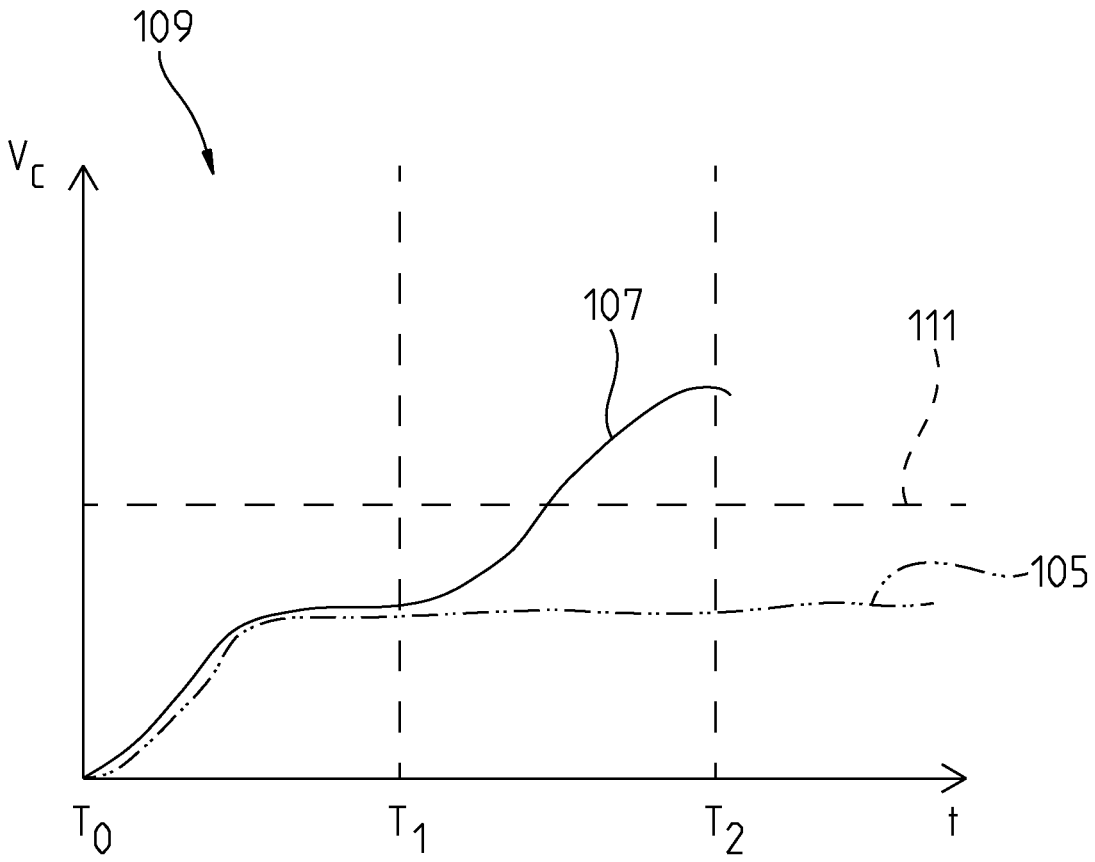
FIG. 7 illustrates an exemplary output of an integrator of the controller of FIG. 5.

Referring to FIG. 7, a graph is provided illustrating the change in magnitude of response variable 109 over a time period between time $T_1$ and time $T_2$ depending on the operating state of pump 12. $T_1$ corresponds to the onset of air being drawn into pump 12. $T_2$ corresponds to a time subsequent to the detection of a starved state. Both $T_1$ and $T_2$ are arbitrary times which may vary depending on the amount of fluid in reservoir 22.

In the illustrated embodiment, pump 12 is initially turned on at time $T_0$, and integrator 106 calculates response variable 109 over the time period defined between $T_1$ and $T_2$. In a normal state of pump 12, the magnitude of response variable 109, as represented by normal curve 105, initially gradually increases due to the presence of some frequencies in the output of filter 104 before settling at a level below threshold 111. In one embodiment, pump 12 operates in a normal state between time $T_1$ and $T_2$. Response variable 109 does not cross threshold 111 while pump 12 is in a normal state due to at least substantially full water flow in volute 40. As such, pump 12 continues to run.

In one embodiment, air begins to be drawn into volute 40 of pump 12 at time $T_1$. The level of response variable 109 may follow normal curve 105 for any period of time before air is drawn into pump 12 at time $T_1$. Starved curve 107 represents the magnitude of response variable 109 when air is drawn into volute 40 of pump 12 at time $T_1$. Between time $T_1$ and $T_2$, the vibration of the parts of pump 12 and the noise in pump 12 begins to increase as more air is drawn into pump 12. As such, the magnitude of response variable 109, as represented by starved curve 107, rapidly increases after time $T_1$ and crosses threshold 111 before reaching time $T_2$. When the magnitude of response variable 109 reaches threshold value 111, pump 12 is in a starved state as defined by controller 24 and pump 12 is shut down.

Comparator 108 compares the response variable 109 to the threshold value 111, as represented by block 214 of FIG. 6. Comparator 108 is configured to detect the fluid condition in pump 12 based on the comparison of response variable 109 and threshold value 111. In one embodiment, the output of comparator 108 is monitored by controller 120 to indicate the detection of a starved operating state of pump 12. If a starved operating state is detected for pump 12 based on the output of comparator 108, controller 120 turns off motor 14 of pump 12, as represented by blocks 216 and 218.

In one embodiment, the comparison of response variable 109 to threshold value 111 serves to distinguish the normal operating state and the starved operating state of pump 12 for the pump system. In particular, when response variable 109 is less than threshold value 111, the amount of air, if any, detected in volute 40 is insufficient to indicate that pump 12 is running dry. Pump 12 therefore is in a normal state and continues to run. When response variable 109 exceeds threshold value 111, the amount of air detected in pump 12 is substantial enough to indicate that pump 12 is running dry or in a starved state. Accordingly, controller 24 turns off pump 12 based on the output of comparator 108.

In one embodiment, the starved state of pump 12 may be determined by running experiments with an intended mechanical configuration of pump 12 and determining what volume of air in volute 40 effects an observable change in the frequency response of pump 12. Such experiments may include injecting air into pump 12 in varying amounts while pump 12 is pumping water, adjusting the parameters of filter 104 and/or integrator 106, and measuring the output of comparator 108. In one embodiment, the starved state corresponds to a fluid condition when air makes up at least about 5% of the fluid in volute 40. In one embodiment, the starved state corresponds to a fluid condition when air makes up at least about 15% of the fluid in volute 40. In one embodiment, the starved state corresponds to a fluid condition when air makes up about 100% of the fluid in volute 40, which indicates pump 12 is operating in a dry condition. The starved state may correspond to a fluid condition when any other suitable amount of air is in volute 40.

Figure 8:
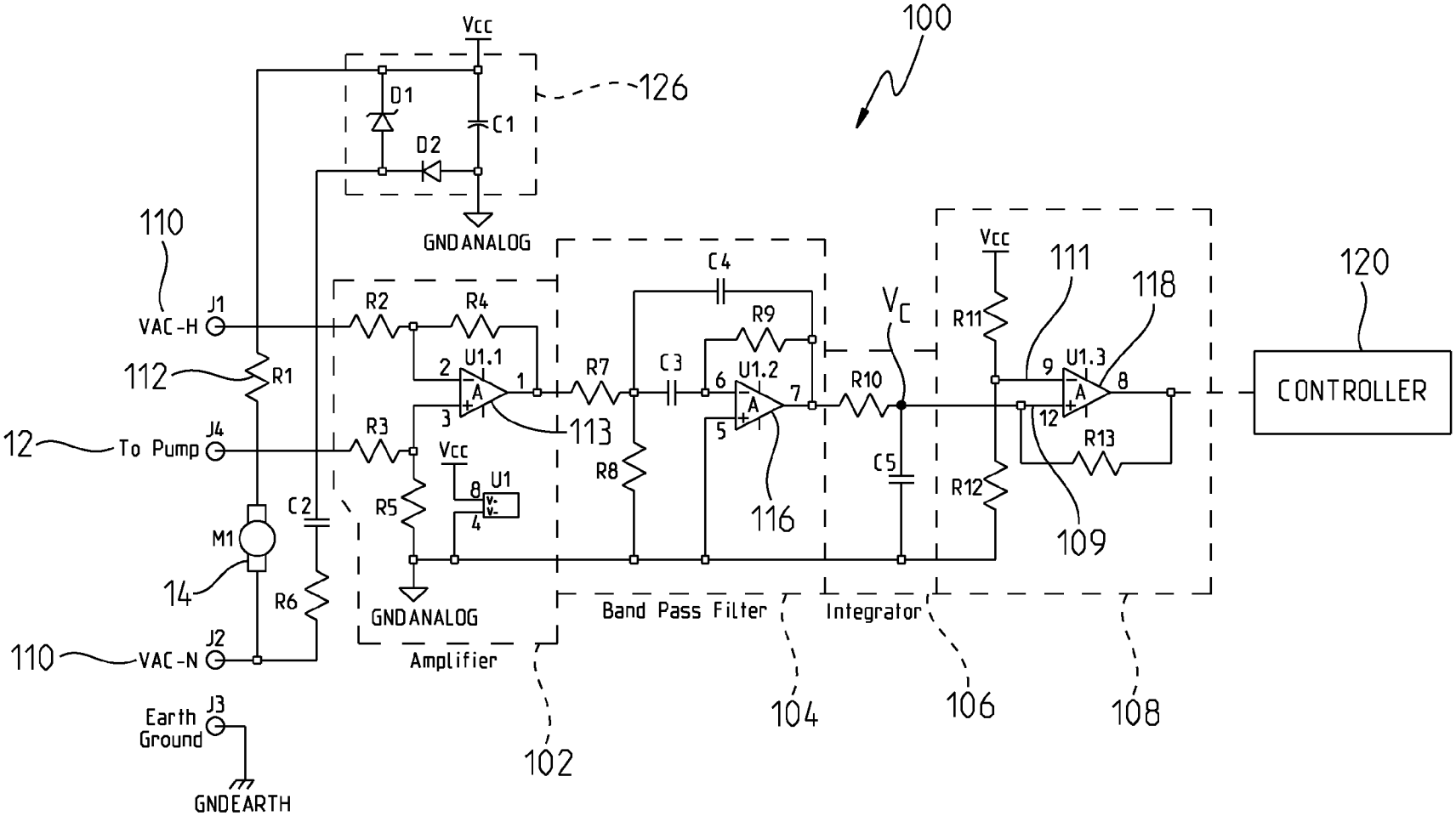
FIG. 8 is an exemplary schematic diagram of the controller of FIG. 5.

Referring to FIG. 8, an exemplary embodiment of analog circuit 100 is shown. Power source 110 is provided to motor 14 across terminals J1 and J2. A rectifier 126 provides a DC voltage source Vcc for use by various components of circuit 100. In particular, the AC power signal from power source 110 is received by resistor R6 and capacitor C2, which are connected in series. R6 and C2 provide a reduced magnitude, pulsed voltage signal to rectifier 126. C2 also serves to limit the current drawn by motor 14 due to its reactance. For example, a 0.44 microfarad capacitor at 60 Hz has a reactance equivalent of around 6030 ohms, which with a 115 VAC power supply may limit the maximum current drawn by motor 14 to around 20 milliamps. Rectifier 126 includes diodes D1 and D2 and capacitor C1. D1 is illustratively a Zener diode configured to limit Vcc to the breakdown or Zener voltage of D1. In the illustrated embodiment, Vcc has a magnitude of around 6 to 9 VDC, but may alternatively have any suitable magnitude for providing a suitable DC voltage source to circuit 100. In the illustrative embodiment, Vcc serves as a DC power supply for the integrated circuit (IC) chips of analog circuit 100.

Exemplary current sensor 112 is a sense resistor R1 positioned in series with motor 14. The current drawn by motor 14, illustratively current signal 122 in FIG. 5, passes through R1 to generate a differential voltage across R1. Exemplary amplifier 102 is a conventional differential amplifier configured to monitor the current passing through sense resistor R1 by receiving as input the differential voltage across R1. Amplifier 102 comprises an operational amplifier or "opamp" 113 and resistors R2-R5. The voltage across sense resistor R1 is amplified by the gain of opamp 113, wherein the gain is defined by the values of resistors R2-R5. Vcc illustratively serves as a power supply to opamp 113.

Exemplary filter 104 is a conventional active band pass filter comprised of resisters R7-R9, capacitors C3-C4, and an opamp 116. The bandwidth and gain of filter 104 may be tuned by altering the values of R7-R9 and C3-C4. Filter 104 filters the output of amplifier 102.

Exemplary integrator 106 is comprised of a resistor R10 and a capacitor C5. R10 and C5 define the time constant for integrator 106. The time constant defines the period of time over which integrator 106 averages the magnitude of the output of filter 104. In order to tune integrator 106 and change the time constant accordingly for each unique pump system, the values of R10 and C5 may be adjusted. Integrator 106 integrates the filtered output of filter 104.

Exemplary comparator 108 is comprised of a resister R13 connected across the non-inverting input and the output of an opamp 118. Opamp 118 receives response variable 109 at a first input and threshold value 111 from a voltage divider network consisting of resistors R11 and R12 at a second input. Response variable 109 is illustratively the voltage "$V_C$". Vcc and the selection of values for R11 and R12 serve to provide threshold value 111 to comparator 108. In the illustrated embodiment, opamp 118 has a "low" or a "high"

output depending on the comparison of the magnitude of response variable 109 to threshold value 111. In another embodiment, comparator 108 may be comprised of a resister R13 connected across an input and an output of a NAND gate which has a "low" or "high" output depending on a comparison of response variable 109 and threshold value 111. An exemplary NAND gate is a 4093 Schmitt trigger NAND gate such as Model No. CD4093BC available from Fairchild Semiconductor.

In one embodiment, opamps 113, 116, and 118 are provided on a single IC. An exemplary opamp IC for amplifier 102, filter 104, and comparator 108 is Model No. LM2904 or LM224 available from a number of suppliers including Fairchild Semiconductor, STMicroelectronics, On Semiconductor, Texas Instruments, and National Semiconductor. Another exemplary opamp IC for amplifier 102, filter 104, and comparator 108 is Model No. TLV2372 available from Texas Instruments.

Referring again to FIG. 7 in conjunction with analog circuit 100 of FIG. 8, the output of opamp 118 is initially low in the time between $T_0$ and $T_1$ when the voltage $V_C$ (i.e. response variable 109) is less than threshold value 111. The output of opamp 118 remains low while pump 12 operates in a normal state, as represented by normal curve 105. As air is introduced into pump 12, $V_C$ increases until it exceeds threshold value 111, as illustrated by starved curve 107 between times $T_1$ and $T_2$. The output of opamp 118 goes high when $V_C$ exceeds threshold value 111, and controller 120 turns off pump 12.

Figure 9:
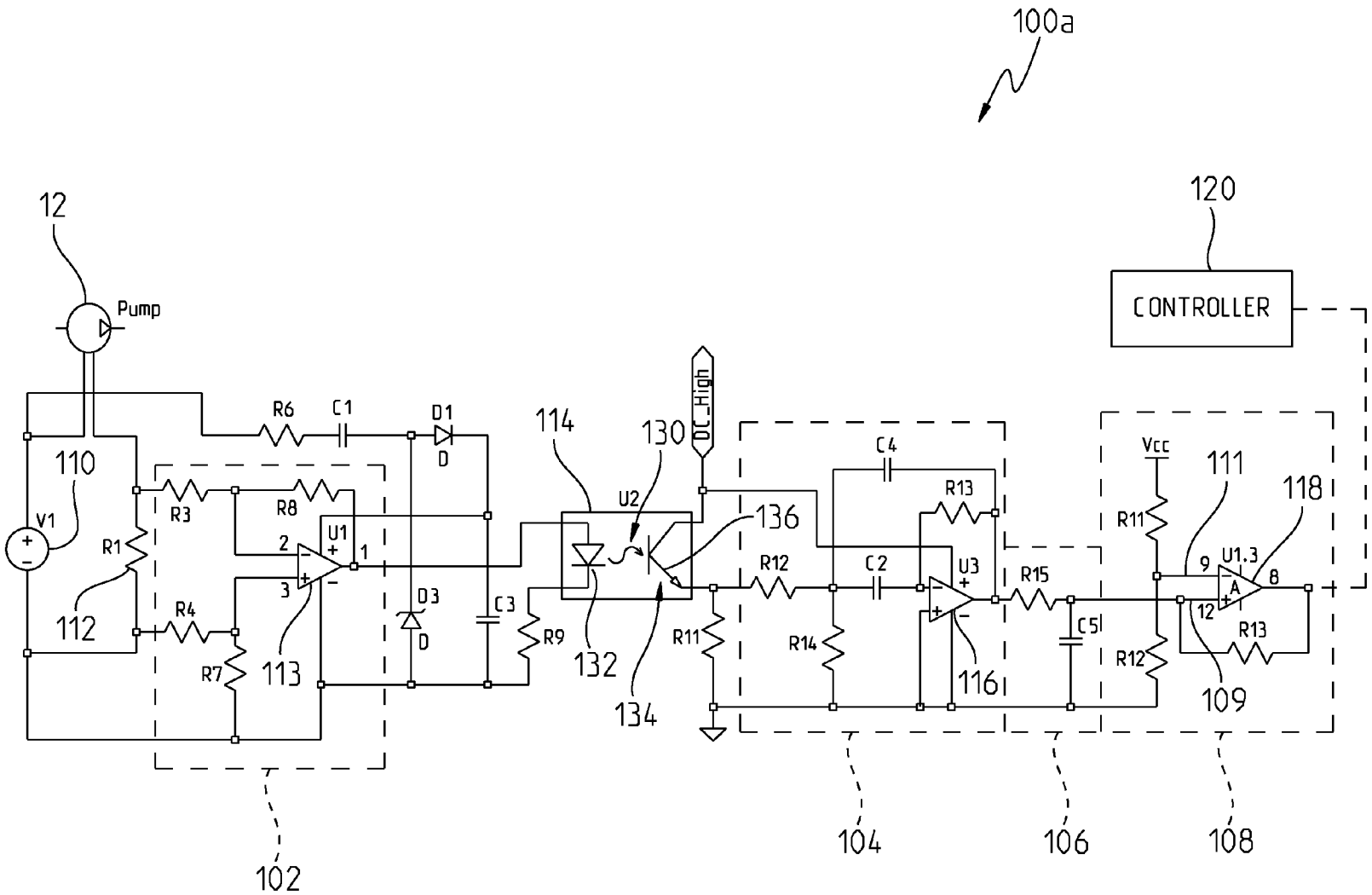
FIG. 9 is another exemplary schematic diagram of the controller of FIG. 5.

Analog circuit 100*a* of FIG. 9 provides an alternative embodiment of analog circuit 100. Circuit 100*a* is similar to analog circuit 100 of FIG. 8 but further includes an isolator 114 positioned between amplifier 102 and filter 104. Isolator 114 passes the sinusoidal signal received from amplifier 102 through a linear isolating photocoupler 130 to filter 104. Photocoupler 130 illustratively includes an infrared LED 132 optically coupled to a phototransistor 134. As the sinusoidal output of amplifier 102 flows through LED 132, a flux is generated by LED 132 which generates a corresponding current through an emitter 136 of phototransistor 134. The current through phototransistor 134 is proportional to the sinusoidal output of amplifier 102 and therefore proportional to the motor current monitored by current sensor 112.

Photocoupler 130 serves to electrically isolate filter 104, integrator 106, and comparator 108 from motor 14 and amplifier 102. As such, voltage spikes and overvoltage from motor 14 are prevented from reaching and possibly damaging filter 104, integrator 106, and comparator 108. An exemplary linear isolating photocoupler 130 is Model No. PC814X available from Sharp Corporation.

In one embodiment, controller 24 may include at least one user input 115 (see FIG. 1) configured to adjust threshold value 111 and/or response variable 109. With controller 24 monitoring the fluid condition in pump 12, various dynamic setpoints for either control events or alarm events may be established which are dependent on the amount of air detected in pump 12. These dynamic setpoints may be set through user input 115. An exemplary user input 115 is a knob which changes a value of a variable resistive element or variable capacitive element. In one embodiment, user input 115 may be used to adjust response variable 109 by adjusting one or more of the values of R7-R9 and C3-C4 of filter 104 and R10 and C5 of integrator 106. In one embodiment, user input 115 may be used to adjust threshold value 111 by adjusting one or both of the values of R11 and R12 of comparator 108. Another exemplary user input 115 is one or more buttons, dials, or other inputs which provide a digital setpoint value to controller 24. In the case of multiple setpoints, a lookup table of setpoints may be stored in memory 72.

Figure 10:
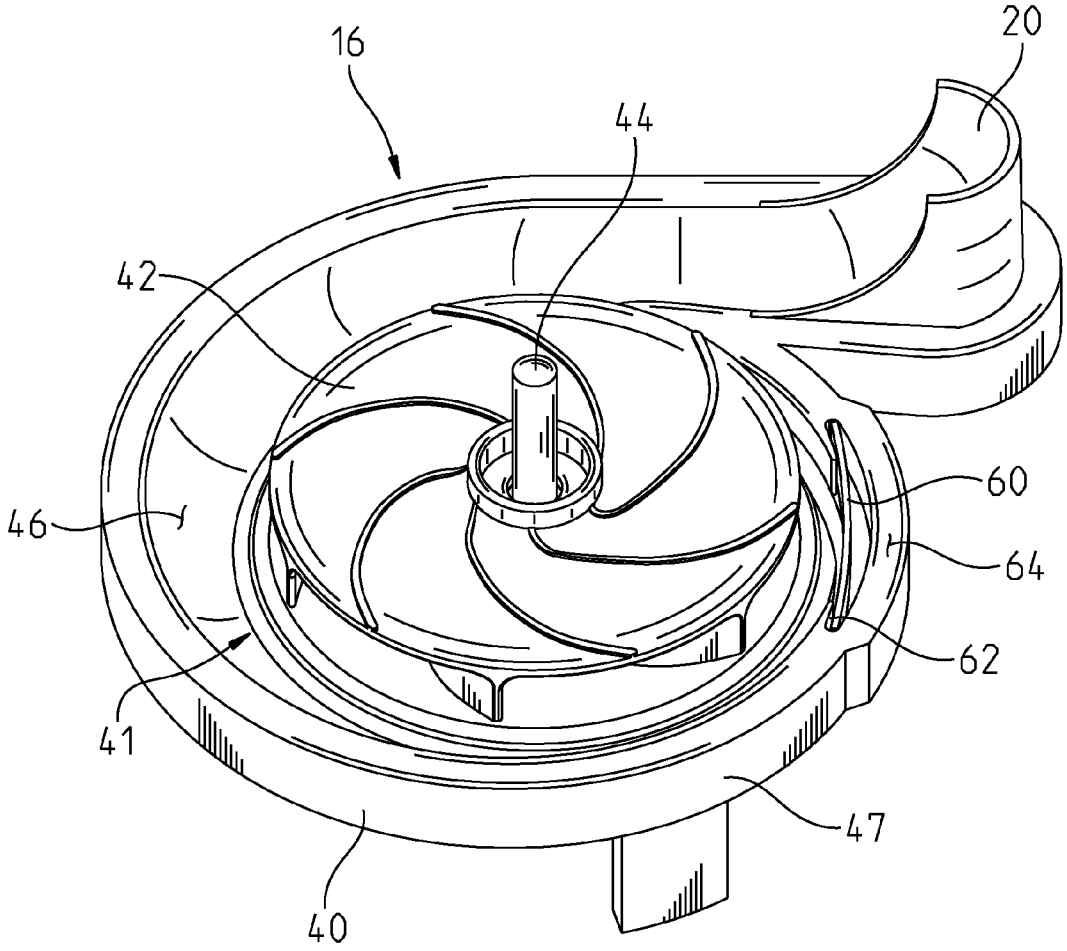
FIG. 10 illustrates an exemplary pump system having a flexible member mounted in an interior portion of a volute.

FIG. 10 illustrates lower portion 47 of an exemplary volute 40 having a flexible member 60 which is used to further distinguish the differences in the frequency response of pump 12 between the normal state and the starved state. Pumping portion 16 is illustrated in FIG. 10 with impeller 42 coupled to shaft 44 and mounted in interior portion 41 of volute 40. A seat 64 around the perimeter of lower portion 47 mates with upper portion 45 of volute 40 (see FIGS. 2A and 2B). In one embodiment, a seal is provided between lower portion 47 and upper portion 45 to seal interior portion 41 of volute 40.

Flexible member 60 is illustratively mounted in a recess 62 of wall 46 of lower portion 47. Flexible member 60 is illustratively flexed to fit into recess 62 such that wall 46 exerts a holding force on flexible member 60 to hold flexible member 60 within recess 62. The curvature of flexible member 60 illustratively follows the curvature of wall 46 to some degree. Positioning upper portion 45 of volute 40 on seat 64 of lower portion 47, as shown in FIGS. 2A and 2B, serves to retain flexible member 60 in recess 62 of volute 40.

Flexible member 60 illustratively is configured to resonate at its natural frequency upon the introduction of air into volute 40. The ringing of flexible member 60 causes a correspondingly higher gain in the frequency response of the current signal. The frequency range of interest monitored by controller 24 is selected to capture the vibration of flexible member 60 at its natural frequency. As a result, the sensitivity of the system is increased for detecting the presence of air in pump 12. Flexible member 60 may be a thin metal piece, a plastic wall, or any other excitable material.

Alternatively, a flexible member (not shown) such as flexible member 60 of FIG. 10 may be mounted in outlet 20 of pump 12. The flexible member may be positioned in outlet 20 such that air or an air/water mixture passing through outlet 20 excites the natural frequencies of the flexible member. As in the embodiment of FIG. 10, the ringing of the flexible member causes a correspondingly higher gain in the frequency response of the current signal and increases the sensitivity of the system for detecting the presence of air in pump 12.

Figure 11:
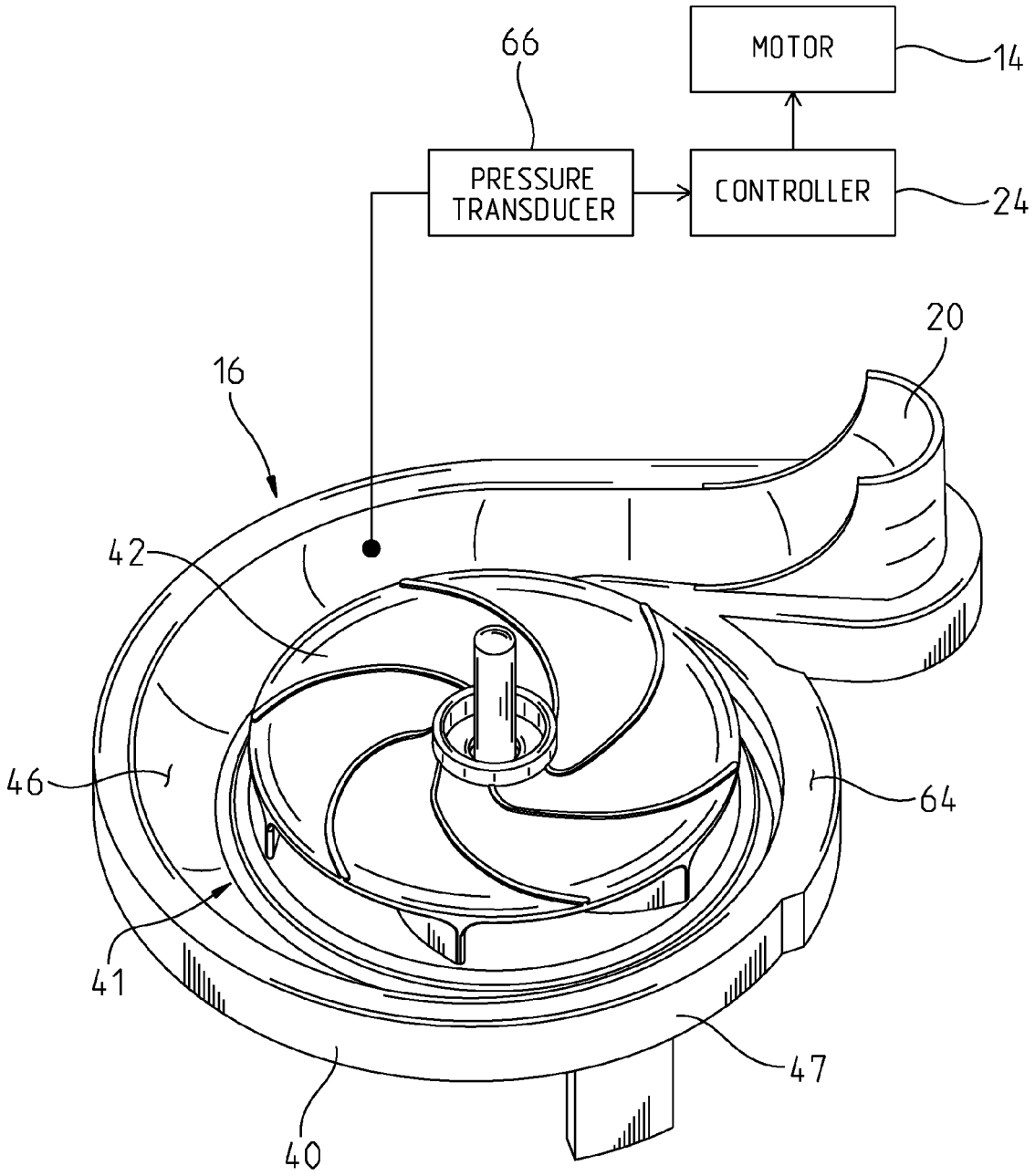
FIG. 11 illustrates an exemplary pump system having a pressure transducer mounted in an interior portion of a volute.

FIG. 11 provides an alternative embodiment for detecting the fluid condition in pump 12 of pump system 10. In the embodiment shown in FIG. 11, a pressure transducer 66 is mounted to wall 46 of volute 40 and is configured to measure the pressure of the fluid within volute 40. Alternatively, pressure transducer 66 may be mounted at any suitable location in pump 12 for detecting fluid pressure within volute 40. Pressure transducer 66 outputs an electrical signal to controller 24 based on the detected fluid pressure. Rather than monitoring the frequency response of the motor current as described above, the frequency response of the output of pressure transducer 66 is used to detect the fluid condition in pump 12.

Similar to the embodiment using the frequency response of motor current described above, the frequency response of the output of pressure transducer 66 is obtained and observed when the pump is operating in a starved state and in a normal state. As with the motor current embodiment, a frequency range of interest is determined based on the frequency response of the output of pressure transducer 66. The output of pressure transducer 66 is monitored within the selected frequency range of interest and compared with a threshold value to detect the presence of air or other fluid inside volute 40 of pump 12. Upon detection of a certain amount of air in volute 40, controller 24 initiates a control event and illustratively turns off pump 12.

In one embodiment, pressure transducer 66 is operated from low voltage power and is not interfaced with the higher voltage main power, illustratively power supply 27 in FIG. 1. In the illustrated embodiment, controller 24 provides the low voltage power to pressure transducer 66. As a result, pressure transducer 66 does not require isolation from the primary power line and thus more easily interfaces with the control electronics of controller 24. An exemplary pressure transducer 66 is Model No. MPX5700DP from Freescale Semiconductor that operates on 5 VDC. Another exemplary pressure transducer 66 is Model No. XPX100DT from Honeywell that Operates on 12 VDC.

In one embodiment of the present disclosure, a method for determining a condition of a pump is provided. The method may comprise sensing an electrical parameter of the pump, passing the signal from the sensor through an electrical filter circuit, and evaluating the output from the filter to determine whether the pump is operating correctly. The electrical parameter may be the current passing though the windings of a motor in the pump. The electrical parameter may be the voltage across the windings of a motor in the pump. The method may include evaluating the result over a period of time to distinguish change events.

In one embodiment of the present disclosure, an apparatus for determining a condition of a pump is provided. The apparatus may comprise a sensor in communication with the windings of the motor of the pump, an amplifier to add a gain factor to the sensor signal, a filter for identifying the contribution to the signal within a frequency range, and means for controlling the pump based on the filtered output. The filter may be an electrical circuit. The filter may be a digital algorithm executed in a microprocessor that processes the signal. The filter may be a low pass filter, a high pass filter, or a band pass filter.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method of controlling an electrically powered fluid transfer system, the method comprising the steps of:

providing a pump configured to displace a fluid, the pump being in one of a first fluid condition wherein a compressible gas is present within the pump and a second fluid condition, wherein the pump has a first frequency response when the pump is in the first fluid condition and a second frequency response when the pump is in the second fluid condition;

selecting a frequency range of interest based on differences between the first frequency response and the second frequency response of the pump;

monitoring at least one characteristic of a frequency response of the pump within the frequency range of interest while the pump is powered, wherein the at least one characteristic of the frequency response includes one of a magnitude of the frequency response and a phase angle of the frequency response;

determining a fluid condition within the pump based on the at least one characteristic of the frequency response of the pump; and altering an operation of the pump when the fluid condition within the pump is the first fluid condition.

2. The method of claim 1, wherein the monitoring step includes monitoring the magnitude of the frequency response of the current drawn by a motor of the pump within the frequency range of interest.

3. The method of claim 2, further comprising the step of determining an average magnitude of the frequency response of the monitored current over a predetermined time period to obtain a relative value of the current.

4. The method of claim 3, further comprising the step of comparing the relative value of the current to a threshold value to determine the fluid condition within the pump, the relative value being dependent on the magnitude of the frequency response of the current within the frequency range of interest, the first fluid condition within the pump being indicated by the relative value crossing the threshold value.

5. The method of claim 1, wherein the compressible gas comprises at least about 5% of the fluid in the pump when the fluid condition is the first fluid condition.

6. The method of claim 1, wherein the compressible gas comprises about 100% of the fluid in the pump when the fluid condition is the first fluid condition.

7. The method of claim 1, wherein the compressible gas is air and the alteration step includes removing power from the pump.

8. The method of claim 1, further comprising the step of providing a pressure transducer within the pump, wherein the monitoring step includes monitoring the magnitude of the frequency response of a signal from the pressure transducer to determine the fluid condition within the pump.

9. A method of controlling an electrically powered fluid transfer system, the method comprising the steps of:

providing a pump configured to displace a fluid, the pump being in one of a first fluid condition wherein a compressible gas is present within the pump and a second fluid condition, wherein the pump has a first frequency response when the pump is in the first fluid condition and a second frequency response when the pump is in the second fluid condition;

providing a flexible member positioned within the pump and configured to resonate upon the introduction of fluid in the pump, wherein the resonation of the flexible member is configured to enhance at least one difference between the first frequency response and the second frequency response of the pump monitoring at least one characteristic of a frequency response of the pump while the pump is powered, wherein the at least one characteristic of the frequency response includes one of a magnitude of the frequency response and a phase angle of the frequency response;

determining a fluid condition within the pump based on the at least one characteristic of the frequency response of the pump; and altering an operation of the pump when the fluid condition within the pump is a first fluid condition.

10. A method of controlling an electrically powered fluid transfer system, the method comprising the steps of:

providing a pump configured to displace a fluid;

monitoring at least one characteristic of a frequency response of the pump while the pump is powered;

determining a fluid condition within the pump based on the at least one characteristic of the frequency response of the pump; and altering an operation of the pump when the fluid condition within the pump is a first fluid condition, wherein the monitoring step includes monitoring the phase angle of the frequency response of the pump at at least a first frequency and the determining step includes determining the fluid condition within the pump based on at least the phase angle of the frequency response.

11. A method of controlling an electrically powered fluid transfer system, the method comprising the steps of:

providing a pump configured to displace a fluid;

monitoring at least one characteristic of a frequency response of the pump while the pump is powered;

determining a fluid condition within the pump based on the at least one characteristic of the frequency response of the pump; and altering an operation of the pump when the fluid condition within the pump is a first fluid condition, wherein the at least one characteristic includes a shift in an anti-resonance peak in the frequency response of the pump.

12. A method of controlling an electrically powered fluid transfer system, the method comprising the steps of:

providing a pump configured to displace a fluid, the pump being in one of a first fluid condition wherein a compressible gas is present within the pump and a second fluid condition, wherein the pump has a first frequency response when the pump is in the first fluid condition and a second frequency response when the pump is in the second fluid condition;

selecting a frequency range of interest based on differences between the first frequency response and the second frequency response of the pump;

monitoring at least one characteristic of a frequency response of the pump within the frequency range of interest while the pump is powered;

determining a fluid condition within the pump based on the at least one characteristic of the frequency response of the pump; and altering an operation of the pump when the fluid condition within the pump is the first fluid condition, wherein the at least one characteristic of the frequency response of the pump is a gain magnitude.

* * * * *